United States Patent [19]

Powell, Jr.

[11] 4,177,621

[45] Dec. 11, 1979

[54] AUTOMATIC FRUIT BAGGING

[75] Inventor: Harry C. Powell, Jr., Faber, Va.

[73] Assignee: Powell Machinery, Inc., Faber, Va.

[21] Appl. No.: 905,173

[22] Filed: May 11, 1978

[51] Int. Cl.[2] ..... B65B 1/32

[52] U.S. Cl. ..... 53/468; 53/469; 53/502; 53/506; 53/572; 177/53; 177/59; 177/122

[58] Field of Search ..... 53/468, 469, 473, 502, 53/506, 572; 177/53, 59, 122, 123, 160

[56] References Cited

U.S. PATENT DOCUMENTS

| | | | |
|---|---|---|---|
| 3,695,371 | 10/1972 | Sheetz | 177/59 |
| 3,696,584 | 10/1972 | Rickard | 53/502 X |
| 3,807,123 | 4/1974 | Kihnke | 53/502 |
| 3,864,894 | 2/1975 | Sheetz et al. | 53/506 |
| 4,010,809 | 3/1977 | Hobart | 177/123 X |
| 4,129,189 | 12/1978 | Maglecic et al. | 177/123 |

*Primary Examiner*—Travis S. McGehee

*Attorney, Agent, or Firm*—Cushman, Darby & Cushman

[57] ABSTRACT

A method and apparatus for bagging bruisable discrete articles, such as apples. The apples are fed single file to a weighing device, and the feed of articles is terminated just before the desired predetermined weight of apples to be bagged. The weighing device is allowed to reach equilibrium, and then the weight of the apples is compared to the desired predetermined weight. If the weight is less than the desired amount, the apples are fed one by one to the weighing device until the predetermined weight is reached or exceeded, at which time the apples in the weighing device are dumped onto a pair of spiral brushes which convey the apples to a bagging station. At the bagging station, a bag is clamped and blown open, and is filled with apples being fed one at a time. The bag full condition is automatically sensed, at which point one of the clamps is released, and an arm supporting the other clamp is pivoted to swing the bag into operative association with an automatic tying machine.

41 Claims, 7 Drawing Figures

67
63
61
61
77
78
92
76
65
66
70
69
F
71
93
93
76
95

AUTOMATIC FRUIT BAGGING

BACKGROUND AND SUMMARY OF THE INVENTION

The invention relates to a method of bagging bruisable discrete articles, and a corresponding system, and two particular component parts thereof. There are numerous commercial structures for the automatic or semi-automatic bagging of bruisable discrete articles, such as apples, and while such commercial structures are generally acceptable, there are a number of limitations and drawbacks associated with them. For instance, most conventional baggers have a bulk and then steady stream (dribble) feed to the weighing mechanism. This often results in an excessive overweight condition. Also, in such commercial structures the weighing is effected dynamically—that is during the continuous feeding, and since the apples drop down into the weighing mechanism, the impact forces can make the weight determination erroneous.

In commercial baggers, the feed from the weighing mechanism to the bagging station also is a bulk feed, which is susceptible to jamming. Also, if the bag is not completely open when apples are fed thereto, the machine operation is interrupted until an operator opens the stuck bag. After the bag is filled, complicated linkages are required for moving the bag to an automatic typing station, and the type of linkage used is dependent upon the particular bag typing machine employed.

According to the present invention, the limitations inherent in the present commercial automatic bagging machines are overcome, and a bagger having much greater accuracy, flexibility, and reliability is provided. According to one aspect of the method according to the present invention, the apples are fed single file to a weighing mechanism, and the feed is terminated just short of the predetermined desired weight of our apples. The weighing mechanism is then allowed to reach equilibrium and the weight of apples is compared to the predetermined desired weight. If the weight is less than the predetermined desired weight, another single apple is fed to the weighing mechanism, the weighing mechanism is again allowed to reach equilibrium, and the weight comparison made. This single feed of apples and weight comparison is continued until the predetermined weight is reached or exceeded, and then the weighing mechanism pan is emptied. In this way, the weight of apples to be bagged will be accurate within the weight range of one apple. The weighing pan employed has a contour that provides a channel for the apples without creating a bottleneck at which the apples can bridge, and the action during emptying of the pan results in a positive feed of all of the apples onto a transporting mechanism for feeding to the automatic bagging station.

The apples are deposited on soft rotating brushes from the weighing pan, and the apples are electronically scanned and the space between apples is measured. This allows sensing of when the last apple has been fed (the bag full condition), and also if the space between the apples is too small a jam condition is indicated, further dumping of the weighing pan or operation of the bag tying mechanism being prevented until the jam is released. The single file feeding of the apples by the soft rotating brushes results in few jams.

If a bag being held to receive apples is not open, the bag clamping mechanisms will automatically recycle until the bag is properly grasped, and feed of apples to the bag is prevented until the bag is in an open condition. Once the bag is filled, it is gripped on only one side thereof and lifted into engagement with the bag tying machine. This eliminates the need for complicated linkages, effects a shift in the position of the bag which causes the apples to settle (contributing to a more uniformly packed bag), and provides flexibility so that a number of different conventional bag tying machines may be utilized. Flexibility is also provided according to the invention since the weighing mechanism and feed therefor may be oriented at any angle with respect to the feed for the bagging station, and operation will still be smooth.

It is the primary object of the present invention to provide an improved method and system for automatically bagging bruisable discrete articles. This and other objects of the invention will become clear from an inspection of the detailed description of the invention, and from the appended claims.

DETAILED DESCRIPTION OF THE DRAWINGS

Figure 1:
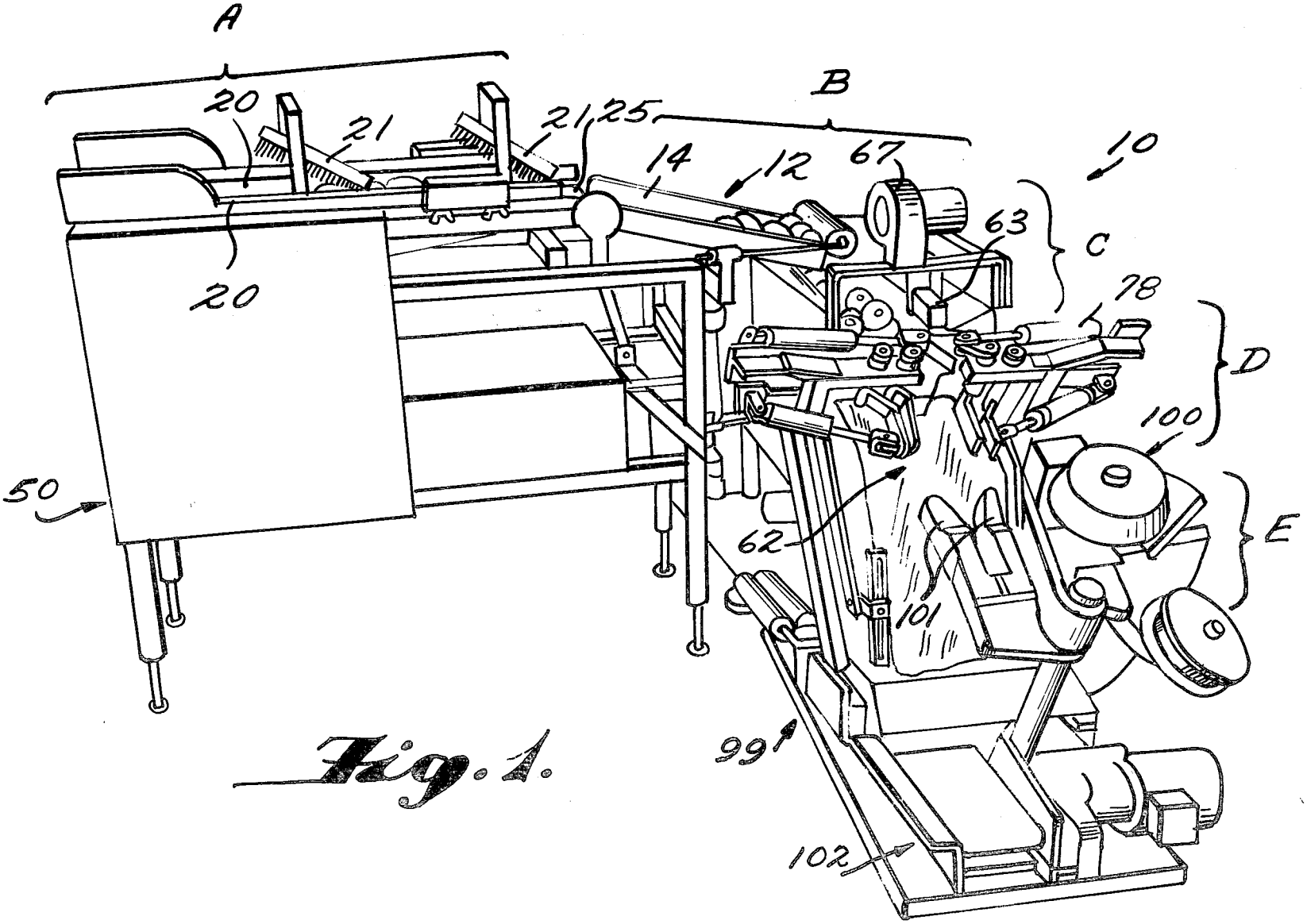
FIG. 1 is a perspective view of an exemplary bagging system according to the invention.

Exemplary apparatus according to the present invention is shown in FIG. 1, the apparatus including an article receipt and feeding station A and a weighing station B, an article receipt and transporting station C, automatic bagging station D, and bag tying station E. The stations A and B are preferably integrally mounted together, as are the stations C, D, and E. The stations A, B, can assume virtually any relative orientation with respect to the stations C, D, and E so that the apparatus 10 is adaptable to different floor space requirements.

Receipt and Feed Station A and Weighing Station B

The apparatus 10 includes a weighing mechanism 12 including an article receiving pan 14 (see FIG. 2 in particular), including means 15 (see FIG. 7) for comparing the weight of articles in the pan 14 to a desired predetermined weight. Means 16 feed the articles single file to the pan 14, and means 18 (see FIG. 7) control the feeding means 16 so that feeding of articles to the pan 14 is terminated when the weight of articles in the pan sensed by the weighing mechanism 12 is just short of the desired weight, and so that the weighing mechanism 12 will be allowed to reach equilibrium after termination of feeding, and so that the feeding means 16 will be actuated to feed a single article to the pan 14 after which feeding is again terminated. Means 19 (see FIG. 3) are also provided for emptying the pan 14 once the predetermined weight of articles has been deposited therein.

The feeding means 16 for feeding articles in single file preferably comprises a pair of conveyor belts 20, with one or more brushes 21 (see FIG. 1) mounted above the belts 20, including one brush 21 mounted just before the pan 14 for briefly increasing frictional resistance to the article movement. This helps ensure that upon cut off of the motor 23 (see FIG. 7) for the conveyors 20 another article will not inadvertently be carried over into the pan 14. A photocell 25 is mounted in the space between the feed means 16 and the pan 14 to sense the passage of an article through that space when the photocell 25 is activated.

Figure 2:
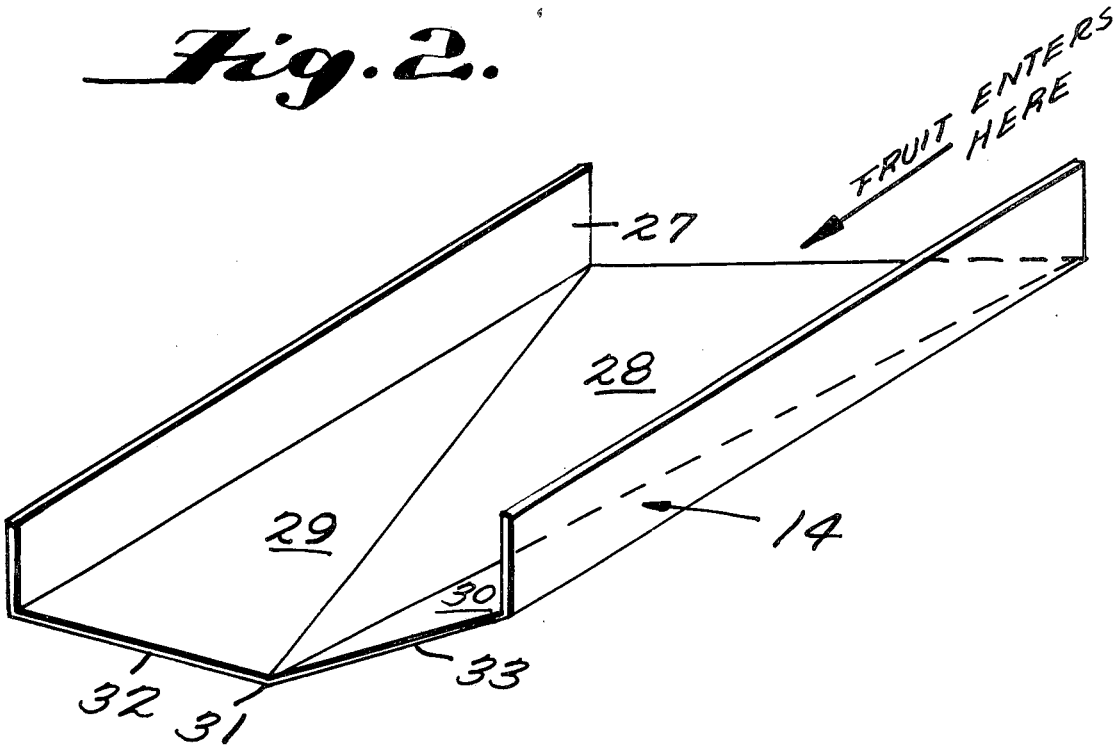
FIG. 2 is a perspective detail view of an exemplary weighing pan according to the invention.

The weighing pan 14 is shown most clearly in FIG. 2, the pan 14 being constructed to provide surface means for channeling articles to the center and front of the pan without creating a bottleneck at which articles can bridge, and for facilitating positive holding yet gentle emptying of the articles from the pan. The pan comprises a bottom component formed of three substantially triangularly shaped surface portions 28, 29, 30. The portion 28 has an apex 31 thereof at the front end of the pan, a base 32, 33 respectively of each of the other surface portions 29, 30 being substantially coincident with the apex 31 and on opposite sides thereof. The bases 32, 33 slant upwardly from the apex. Sidewalls 27 are also provided for containing the articles within the pan 14.

Figure 3:
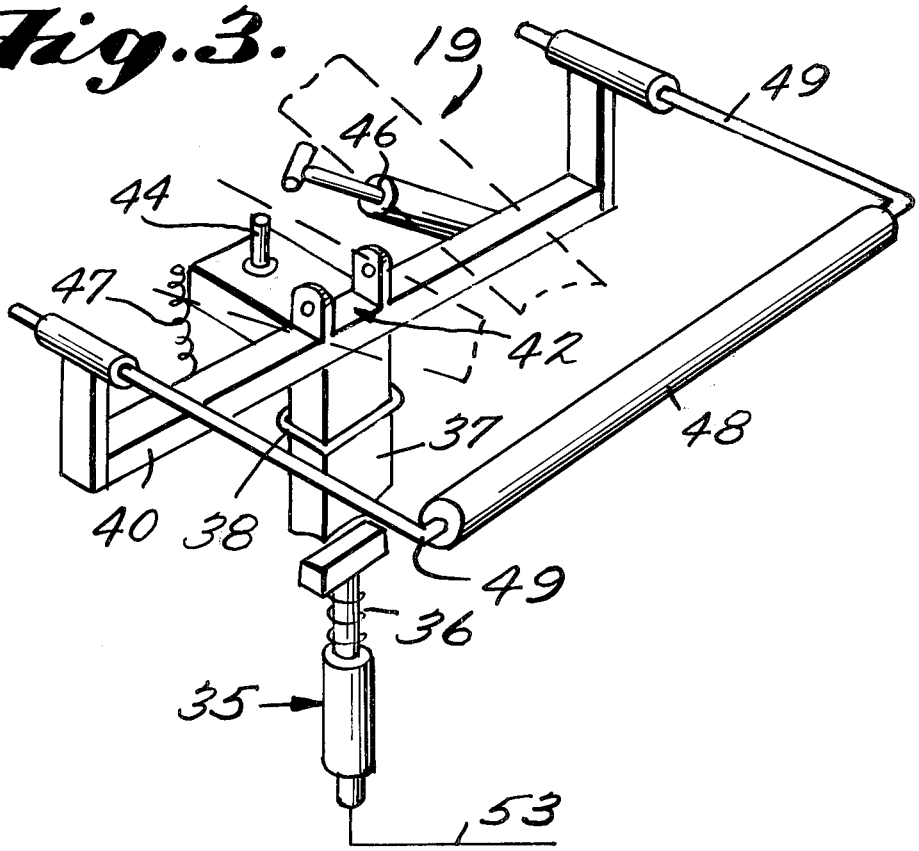
FIG. 3 is a perspective schematic view of an exemplary weighing mechanism according to the present invention, with the weighing pan shown only partially and in dotted line.

The details of an exemplary weighing mechanism according to the present invention with which the pan 14 is eminently utilizable are shown schematically in FIG. 3. The weight responsive and comparing means 15 may comprise any suitable mechanism that is responsive to weight, especially one for transforming mechanical movement as the result of the weight to an electrical signal, but preferably comprises a conventional linear variable differential transformer 35 (hereinafter LVDT). A spring 36 or the like may be provided associated with the LVDT for acting on a support component 37 for the rest of the weighing mechanism 12. The support component 37 is adapted to reciprocate up and down guided by the bail 38, and a cross arm structure 40 is mounted on top of the support 37. The pan 14 (shown only partially and in dotted line in FIG. 3 for clarity) is pivotally mounted by conventional means 42 to the cross arm 40, and an adjustable stop 44 is provided associated with cross arm 40 for abutting the bottom of the pan 14 and holding it in its normal article receiving position. The pan emptying means 19 preferably includes a hydraulic cylinder 46 pivotally mounted to the bottom of the pan 14, a spring 47 being provided for returning the pan 14 to abutting engagement with the stop 44 after emptying thereof. A roller 48 of spongy material is mounted by arms 49 operatively connected to the cross arm 40 so that the roller 48 is in front of the pan 14, and in the normal position of the pan, abutting the stop 44, the roller 48 prevents articles in the pan 14 from exiting out the front thereof. As shown in FIG. 1, the stations A and B preferably are mounted on a single supporting frame 50, the whole structure 50 being movable with respect to the station C to deposit articles in station C at any desired relative orientation.

Figure 7:
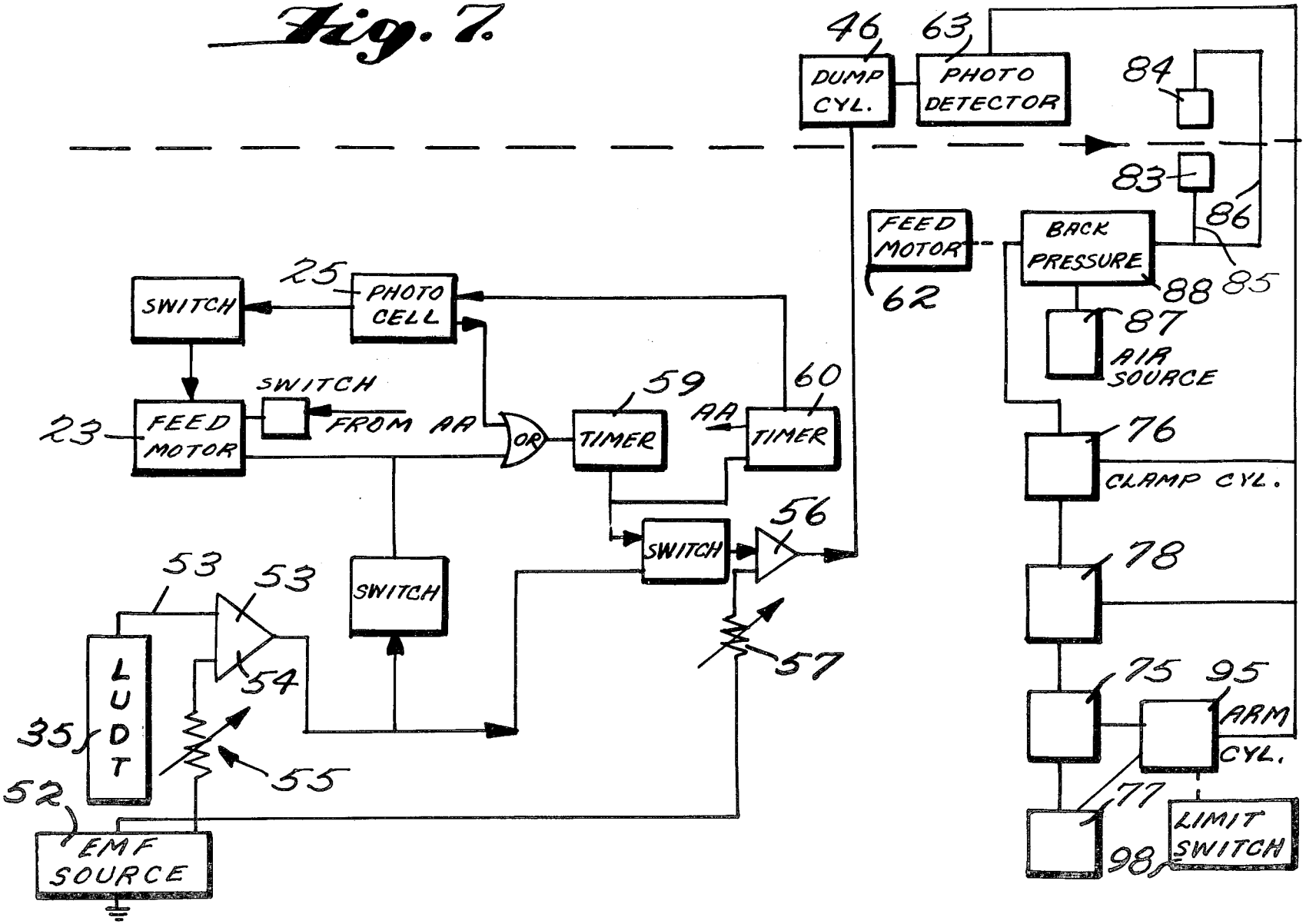
FIG. 7 is a block diagram showing the interrelationship between examplary components for controlling the system of FIG. 1 for practicing the method of the invention.

The weight comparison and controlling means 15, 18 are shown schematically in FIG. 7. A power source 52 is provided for the LVDT 35 and other control functions, and a line 53 leads from LVDT 35 to the first and second conventional differential comparators 54, 56 or the like. The differential voltage comparators 54, 56 each have a potentiometer 55, 57 respectively associated therewith for adjusting the reference voltage which they compare to the LVDT 35, the adjustment of the reference voltage corresponding to adjustment of the weight in the pan 14. Once the voltage of the current in line 53 is greater than that supplied by the constant power source 52 through the potentiometer 55, the feed motor 23 will be turned off, and the current will be fed through timer 59 to the second differential voltage comparator 56. The timer 59 allows the weighing mechanism 12 to go to equilibrium before the voltage comparison is made at comparator 56. If the voltage of the current from timer 59 is not greater than the reference supplied by power source 52 through potentiometer 57, then the current, through timer 60, initiates restarting of the feed motor 23, and also puts the photocells 25 in an active mode. The photocell 25 then senses the passage of a single article in the space between the conveyors 20 and the pan 14, and then again shuts off the feed motor 23. Again, the weighing mechanism 12 is allowed to reach equilibrium by timer 59, and then the comparison by component 56 is again made. The cycle is continued until the voltage of the current from line 53 is equal to or greater than the voltage of the current supplied by power source 52 through potentiometer 57, at which point the component 56 actuates the dump cylinder 46 to dump the articles from the pan 14 to the transporting station C.

Operation A, B

Bruisable discrete articles, such as apples, are deposited on the conveyor belts 20, and are fed single file past the brushes 21 to the pan 14 of the weighing mechanism 12. The potentiometers 55, 57 are adjusted so that voltage from power source 52 through potentiometer 57 corresponds to the desired predetermined weight of apples to be bagged, and that through potentiometer 55 is just short, though measurably less, than that of 57 (preferably about the weight of one apple apart). Feeding of the apples to the pan 14 is terminated by cutting off feed motor 23 just short of the predetermined desired weight once the voltage in line 53 from LVDT 35 equals or is greater than that through potentiometer 55, the differential voltage comparator 54 turning off the motor 23. The weighing mechanism 12 is allowed to reach equilibrium since the current passes through timer 59, and then the voltage comparison is made by the comparator 56.

If the weight of apples in pan 14 is less than the predetermined desired weight, current passes from timer 59 through timer 60 to turn the feed motor 23 back on, and to activate the photocell 25. The photocell 25 senses the passage of a single article into the pan 14, and then cuts off the feed motor 23, and after the weighing mechanism 12 is again allowed to reach equilibrium, another voltage comparison is made by comparator 56. This process continues until the weight of articles in pan 14 is greater than or equal to the predetermined desired weight, at which time the comparator 56 activates the cylinder 46 to pivot the pan 14 about pivot point 42 so that the front 31, 32, 33 of the pan 14 clears the bottom of the roller 48 a sufficient distance to allow the apples to roll out of the pan 14 to the station C.

Stations C, D, and E

Station C includes means for transporting the articles emptied from the pan 14 to the automatic bagging station D so that they move in single file, and includes a pair of soft bristle spiral brushes 61 (see FIG. 4) which are powered by a motor 63 (see FIG. 7). The singular flow provided virtually eliminates clogging at the neck of the bag, reduces the kinetic energy absorbed by the apples to an absolute minimum, and effects deposit of the apples in the bag without bending or sudden constrictions. A proximity type photodetector 63 is mounted above the brushes 61 at the interface between stations C and D (see FIGS. 4 and 5 in particular), and comprises means for sensing both when the bag F is full, and a jam condition of apples. This is accomplished since the photodetector 63 measures the distance between the articles, and if the distance is too small, indicating a jam, the dump cylinder 46 is controlled so that it can dump no more apples into the station C, and also a "bag full" condition is precluded so that the bag being filled will not be removed to the bag tying station E. Also, an audible or visual signal may be provided to indicate to an operator that the jam is to be broken up, or automatic jam-breaking action can be initiated.

The automatic bagging station D includes conventional means 64 for providing a supply of bags that will automatically move the top bag in position to be received by the automatic clamping means 65, a wicker or the like being provided associated with the bag supply means 64. A lip 66 (see FIG. 4) is provided to facilitate the movement of the top bag F from the supply 64 into place in association with the clamping means 65, and also to deflect the air from blower 67 directly into the bag F held by the clamping means 65 so that the bag is blow open. The fan 67, as shown in FIGS. 1 and 4, is mounted above the interface between station C, and D, and its position is adjustable to provide the exact direction of the air stream that will effect opening of the bag held by the clamping means 65.

Figure 4:
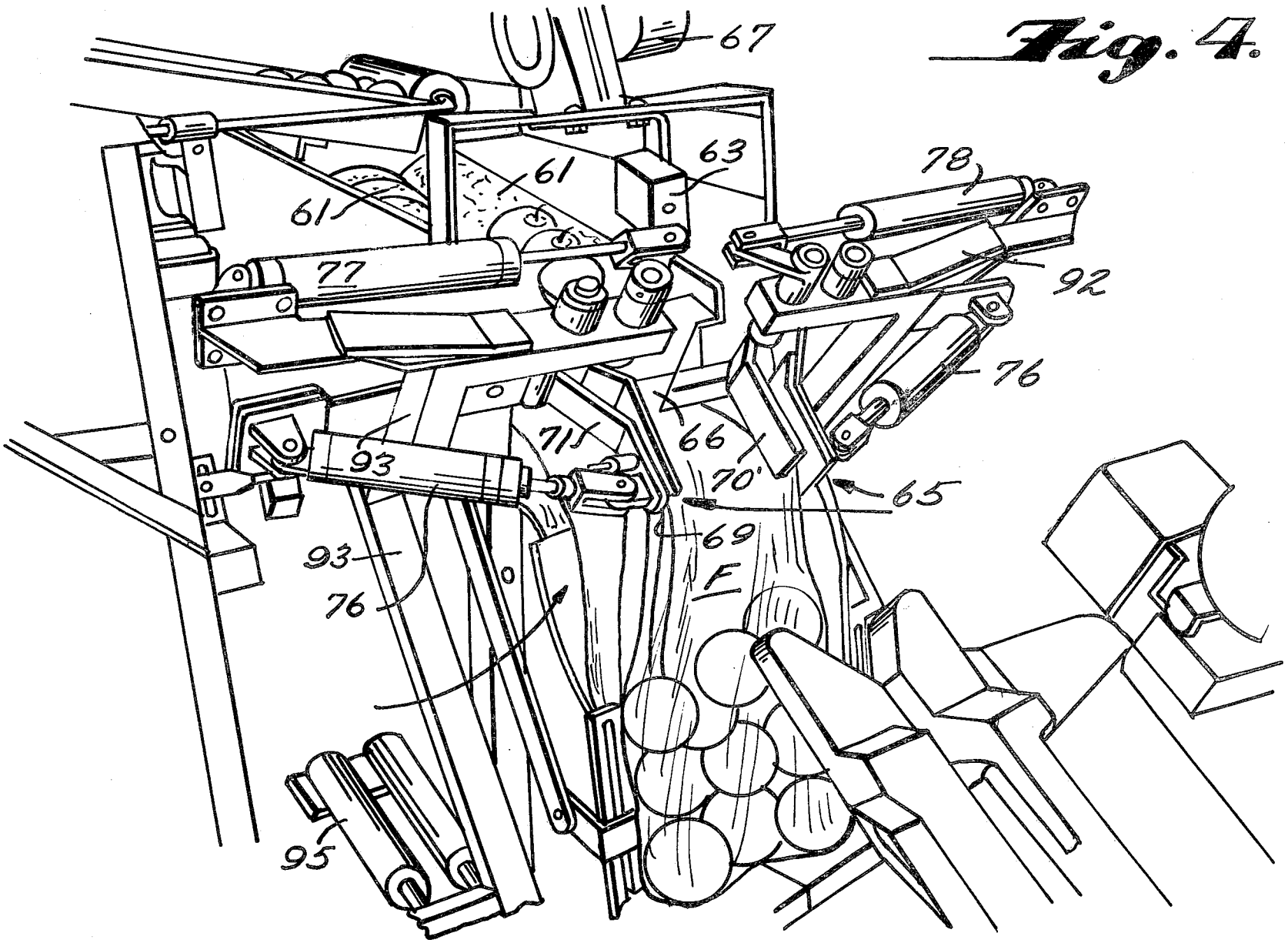
FIG. 4 is a perspective detail view of an exemplary automatic bagging station, with feed to the station, according to the invention.
Figure 5:
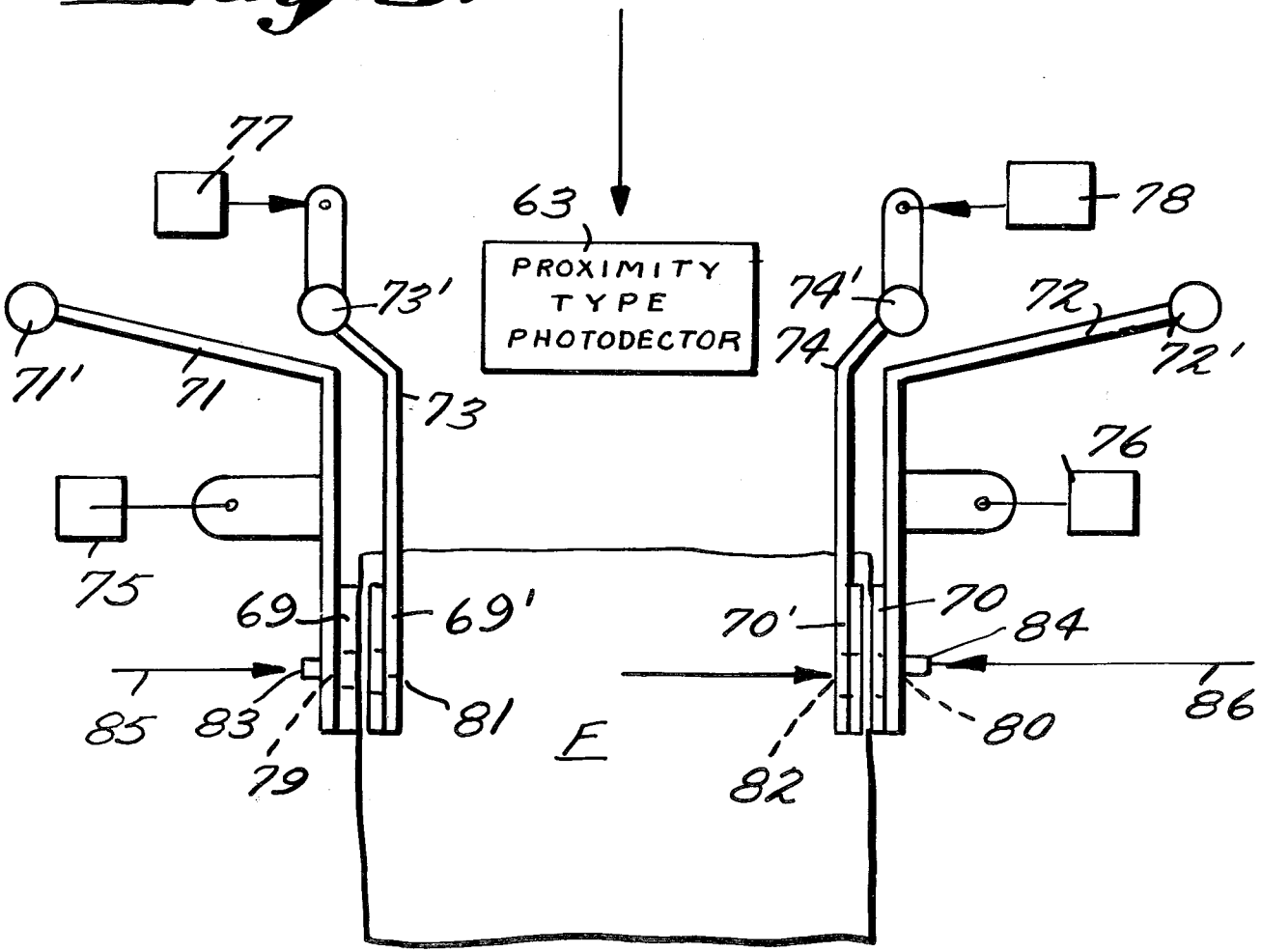
FIG. 5 is a top schematic view of the bag clamping means of FIG. 4.

The clamping means 65 is shown most clearly in FIGS. 4 and 5, and includes two pairs of clamping pads 69, 69′ and 70, 70′, for grasping the bag F at two spaced sides thereof. Preferably, sponge rubber is provided as the material for pads 69, 69′, 70, 70′. Level 71, 72, 73, and 74, pivotal about points 71′, 72′, 73′, and 74′, mount pads 69, 70, 69′, and 70′, respectively, and cylinder 75, 76, 77, and 78 respectively act on the levers 71, 72, 73, and 74 to pivot them about the pivot points to move the pads 69, 69′ and 70, 70′ toward and away from each other for releasing or gripping of the bag F.

According to the invention, means are provided for automatically sensing whether or not a bag F is held open for receipt of articles, and for correcting the situation if the bag is not held open. Such means include means for sensing the grip on the bag by the clamping means 65 and automatically recycling the clamping means to grip the bag if the grip on the bag is insufficient, and for preventing transport of articles to the bag until the grip is sufficient. Such means are preferably provided by openings 79, 80, 81, and 82 formed in the pads 69, 70, 69′ and 70′ respectively, the openings 79, 81 being aligned, and the openings 80, 82 being aligned. An air jet 83 is disposed in opening 79, and an air jet 84 is disposed in opening 80, lines 85 and 86 leading to the air jets 83, 84 respectively from an air source 87, through a back pressure switch arrangement 88. When the pads 69, 69′ and 70, 70′ are brought together by the respective cylinders 75, 77 and 76, 78, if the grip on the bag is sufficient, a portion of the bag will extend between the pads of each pair of pads, blocking off the openings 81, 82. Under these circumstances, air will not be able to pass through the openings 81, 82, and a back pressure sill be transmitted to back pressure switch 88, and the transport of articles to the bag by the motor 62 will be allowed to continue, until the bag full condition is sensed by the proximity type photodetector 63. If, however, the bag is not sufficiently clamped so that air is allowed to pass through opening 81 or through opening 82, the back pressure switch 88 will not be activated, and this will thus effect control of the feed motor 62 to stop feeding of articles toward the bag, and will control the cylinders 75 through 78 to recycle the gripping pads, opening the gripping pads back up and then closing them again. This process will continue until the pads positively grip the bag.

All of the cylinders and levers for moving the gripping pads 69, 69′, 70, 70′, preferably are mounted on convenient supporting structures 92, 93 (see FIG. 4). The arm 93 also comprises automatic means for picking up the full bag F and moving it into operative relationship with a conventional automatic bag clamping (tying) means 100. According to the present invention, when the bag is full, it is only lifted up on one side thereof, and moved to the tying means 100, i.e. the gripping pads 70, 70′ being released while the gripping pads 69, 69′ remain in clamping mode while the support arm 93 moves. In this way, there is no necessity for complicated linkages, when the bag is picked up there is a shift in position which contributes to desirable settling of the apples in the bag, and the automatic bagging station D can be used with a wide variety of conventional tying machines 100 in the tying station E.

Figure 6:
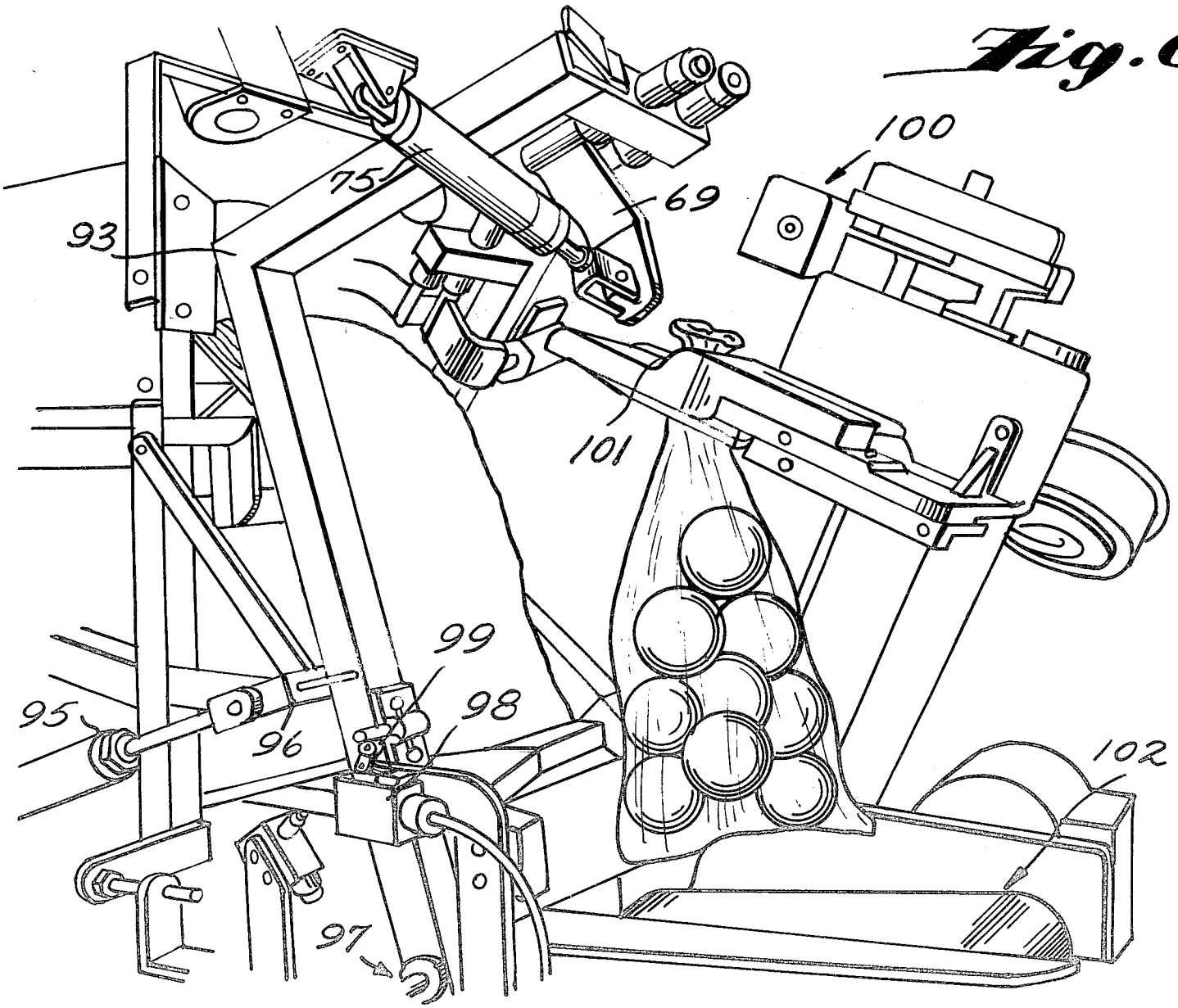
FIG. 6 is a side perspective view of the automatic bagging station of FIG. 4 showing the clamping arm in a position to which it has been moved for bag tying.

The automatic pickup means comprises power means, such as a hydraulic cylinder 95 (see FIG. 6), pivotally mounted to an offset portion 96 of the arm 93 for pivoting the arm 93 about a pivot axis at 97. A limit switch 98 is provided at the end of the path of pivotal movement of the arm 93, which switch 98 is actuated by actuator 99 on arm 93, so that when a full bag is moved into operative association with the automatic tying means 100 (see FIG. 6), the cylinders 75, 77, are controlled to automatically release the bag. A pair of arms 101 of the tying machine 100 receive the bag therebetween, and effect tying in any conventional manner. After being tied, the full bag is deposited on an integral conveyor belt 102, which has a false bottom and is gentle to the bag, and the bag is then transported onto a further activity station—such as to a station for storage or transport. The height of the belt 102 is adjustable to accommodate bags of different sizes without resulting in bruising of the fruit, and to accommodate different types of bag closing machines 100.

Operation C, D, E

Once the apples are dumped onto the soft bristle spiral brushes 61 from the pan 14, they are conveyed single file toward the automatic bagging station D. The cylinders 75 through 78 are operated to close the gripping pads 69, 69′, 70, 70′ to grip a bag F at opposed side portions thereof, the lip 66 extending into the bag, and air from adjustable blower 67 causing the bag F to blow open. Apples are fed continuously from brushes 61 into bag F until the last apple is deposited in the bag, which is sensed by the proximity type photodetector 63. The detector 63 then operates the cylinders 76 and 78 to release clamping on one side of the bag, while clamping is maintained by the cylinders 75, 77, and the power means 95 for the arm 93 is actuated to swing the full bag into operative association with arms 101 of the automatic tying machine 100. When the arm 93 reaches its furthest extent of travel, the limit switch 98 is actuated, which actuates the cylinders 75, 77 to relese clamping of the bag, and returns the arm 93 to position over the next bag F in the stack 64. The tying machine 100 automatically clamps the bag, deposits it on the conveyor 102, and the bag is transported to a further activity station.

Should for any reason a jam-up condition occur in the station C, this will be sensed by the photodetector 63, which measures the distances between articles, and it will control the dump cylinder 46 to ensure that no further articles are deposited from pan 14 into station C, and an alarm may be operated to indicate that the jam-up has occurred.

If for any reason, the gripping pads 69, 69', 70, 70' do not have a positive grip on the next bag F, this will be sensed by the back pressure switch 88, which will control the feed motor 62 to stop transport of apples from station C to station D, and will effect automatic recycling of the cylinder 75 through 78 until the proper grip on the bag is obtained, at which point feed motor 62 is again started.

Thus, it will be seen that according to the present invention, a method and system for the automatic bagging of bruisable discrete articles (and component parts for the system) have been provided which overcome many of the limitations inherent in present commercially available automatic or semiautomatic baggers. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, systems, and apparatus.

What is claimed is:

1. A method of bagging bruisable discrete articles utilizing a weighing mechanism, comprising the steps of (a) feeding the articles single file to the weighing mechanism, (b) terminating feeding of the articles to the weighing mechanism just short of a predetermined desired weight of articles, (c) allowing the weighing mechanism to reach equilibrium and then weighing the articles in the weighing mechanism and comparing the weight of articles to the predetermined desired weight, (d) if the weight is equal to or greater than the predetermined desired weight, emptying the weighing mechanism, (e) if the weight is less than the predetermined desired weight, reinstituting feeding until another single article is fed to the weighing mechanism, and (f) terminating feeding to the weighing mechanism after the single another article is fed, and then repeating steps (c) and (e) until the conditions in step (d) are met.

2. A method as recited in claim 1 comprising the further steps of (g) transporting the articles emptied from the weighing mechanism to an automatic bagging station in single file, (h) automatically clamping a bag, and blowing it into open condition, to be filled by articles, (i) automatically indirectly sensing when the bag is full, (j) automatically picking up the full bag, tying it, and transporting it to a further activity station, and (k) automatically clamping another bag and holding it in open condition to receive a further batch of articles from the weighing mechanism.

3. A method as recited in claim 2 wherein said method further comprises the step of automatically sensing a jam condition of articles being fed to the open bag, and preventing further emptying of the weighing mechanism and picking up of the bag in response to the jam condition.

4. A method as recited in claim 3 wherein said bag full and jam sensing steps are accomplished simultaneously utilizing a single mechanism.

5. A method as recited in claim 2 wherein said step of automatically picking up the full bag is accomplished by picking up the bag adjacent the open top thereof at a single area of contact from only one side of the bag.

6. A method as recited in claim 2 comprising the further step of automatically sensing when the bag is in the open condition, and recycling the automatic clamping action while preventing transport of articles to the bag until the open condition of the bag is sensed.

7. A method as recited in claim 6 wherein said step of automatically sensing when the bag is open is accomplished by pneumatic sensing of the grip on the bag when the bag is clamped.

8. A method as recited in claim 1 wherein step (b) is accomplihsed by automatically sensing the weight of articles in the weighing mechanism and effecting feeding termination when the weight is a substantial amount short of the predetermined weight, and wherein step (c) is accomplished by determining the elapse of time after feeding termination, and making the final weight comparison only after a predetermined time has elapsed.

9. A method as recited in claim 1 wherein step (c) is accomplished by determining the elapse of time after feeding termination, and making the final weight comparison only after a predetermined time has elapsed.

10. A method as recited in claim 1 wherein step (a) is accomplished by mechanically conveying the articles toward the weighing mechanism and briefly increaisng the frictional resistance to article movement just before the articles are actually disposed in the weighing mechanism.

11. A method as recited in claim 10 wherein said step of briefly increasing frictional resistance is accomplished by disposing a brush above the articles and in contact therewith just before the weighing mechanism.

12. A method as recited in claim 1 comprising the further step of retaining the articles in the weighing mechanism until emptying by providing a sponge covered roller in front of the weighing mechanism, and wherein said emptying step is accomplished by tilting the weighing mechanism so that the front thereof tilts below the level of the sponge covered roller.

13. A method as recited in claim 1 wherein said weighing of step (c) is accomplished by providing a LVDT operatively attached to the weighing mechanism, and comparing the voltage of the signal generated by said LVDT to a reference voltage.

14. A method of bagging bruisable discrete articles utilizing a weighing mechanism and a pair of clamping mechanisms, comprising the steps of (a) feeding the articles to the weighing mechanism,
(b) sensing when a predetermined wieght of articles are in the mechanism,
(c) emptying the weighing mechanism when the predetermined weight of articles has been reached,
(d) transporting the articles emptied from the weighing mechanism to an automatic bagging station in single file,
(e) automatically clamping a bag to be filled by articles on two spaced sides thereof with the clamping mechanisms, and blowing it into open condition,
(f) automatically indirectly sensing when the bag is full,
(g) automatically picking up the full bag by maintaining clamping with one clamping mechanism and terminating clamping with the other clamping mechanism, and moving the one clamping mechanism, and
(h) automatically tying the picked-up full bag.

15. A method as recited in claim 14 comprising the further steps of
(i) moving the tied bag to another activity station,
(j) releasing clamping of the full bag by the one clamping mechanism after transporting the bag to the another activity station, and
(k) automatically clamping another bag on two spaced sides thereof with the clamping mechanisms, and then repeating steps (f) to (j).

16. A method as recited in claim 14 comprising the further step of automatically sensing a jam condition of articles being fed to the open bag, and preventing further emptying of the weighing mechanism and picking up of the bag in response to the jam condition.

17. A method as recited in claim 16 wherein said bag full and jam sensing steps are accomplished simultaneously utilizing a single mechanism.

18. A method as recited in claim 14 comprising the further step of pneumatically sensing the grip on the bag by said clamping mechanisms, and automatically recycling the clamping mechanisms to regrip the bag if the grip on the bag is insufficient.

19. A method as recited in claim 14 comprising the further step of automatically sensing when the bag is in the open position by sensing the grip on the bag by the clamping mechanisms, and automatically recycling the clamping mechanisms to regrip the bag if the grip on the bag is insufficient, while preventing transport of articles to the bag until the open condition of the bag is sensed.

20. A system for bagging bruisable discrete articles comprising
a weighing mechanism including an article receiving pan and means for comparing the weight of articles in said pan to a desired predetermined weight,
means for feeding articles single file to said pan,
means for controlling said feeding means so that feeding of articles to said pan is terminated when the weight of articles in said pan sensed by said weighing mechanism is just short of said desired weight, and so that said weighing mechanism will be allowed to reach equilibrium after termination of said feeding, and so that said feeding means will be actuated to feed a single article to said pan after which feeding is again terminated, and
means for emptying said pan.

21. A system as recited in claim 20 wherein said weighing mechanism includes an LVDT operatively associated with said pan.

22. A system as recited in claim 20 wherein said article receiving pan comprises a bottom component formed of three substantially triangularly shaped surface portions, one of said surface portions having the apex thereof at the front end of said pan, a base of each of the other surface portions being substantially coincident with said apex and on opposite sides thereof, and said bases each slanting upwardly from said apex, so that said pan channels articles to the center thereof without creating a bottleneck at which articles could bridge.

23. A system as recited in claim 20 wherein said controlling means comprises a timer for ensuring that said weighing mechanism reaches equilibrium before comparing the weight of articles in said pan to said predetermined weight.

24. A system as recited in claim 20 wherein said weighing pan comprises a pan having a channel formed therein, and further comprising means for pivotally mounting said pan generally about a central portion thereof, and a spongy roller disposed in fornt of said channel at the pan front, and wherein said means for emptying said pan comprises means for pivoting said pan about said pivotally mounting means so that the front of said pan dips sufficiently below said spongy roller to allow passage of articles out of said pan.

25. A system as recited in claim 20 further comprising
means for transporting the articles emptied from said pan to an automatic baggin station in single file,
means providing a supply of bags at said bagging station,
means for automatically clamping a bag from said supply, and positioning the bag to be filled by articles from said transporting means.

26. A system as recited in claim 25 wherein said automatic clamping means comprises means for clamping said bag at two spaced sides thereof; and further comprising means for pneumatically sensing the grip of the bag by said clamping means, and automatically recycling said clamping means to regrip the bag if the grip on the bag is insufficient, and for preventing transport of articles to the bag until the grip is sufficient.

27. A system as recited in claim 26 wherein clamping means comprises two pair of gripping pads, and wherein said pneumatic sensing means comprise a pair of air jets, one for each pair of gripping pads extending into one pad of each pair with the other pad of each pair having an opening formed therein, and a backpressure switch for sensing backpressure from said air jets.

28. A system as recited in claim 25 further comprising means for automatically tying the bag when full, and automatic means for picking up the full bag with only one of said two pair of gripping pads, and moving it into operative relationship with said tying means, said automatic pickup means comprising power means for lifting only one of said two pair of gripping pads while retaining said one pair in clamping position.

29. A system as recited in claim 28 wherein said power means comprises a pivoted arm mounting said one pair of gripping pads, and means for moving said arm about its pivot.

30. A system as recited in claim 25 further comprising means for automatically indirectly sensing when the bag is full.

31. A system as recited in claim 30 further comprising means for sensing a jam condition of articles being fed to the bag and initiating prevention of further emptying of said pan until the jam condition is cleared.

32. A system as recited in claim 31 wherein said full and jam condition sensing means comprise a single proximity type photodetector.

33. A system as recited in claim 25 wherein said means for transporting the articles from said pan to the automatic bagging station in single file comprises a pair of rotating spiral brushes.

34. A system as recited in claim 20 wherein said means for feeding articles single file to said pan comprises conveying means and means for briefly increasing frictional resistance to article movement just before said pan.

35. A system as recited in claim 34 wherein said means for briefly increasing frictional resistance comprises a brush disposed above the articles just before said pan.

36. A system for bagging bruisable discrete articles comprising a weighing mechanism, means for feeding the articles to said weighing mechanism, means for emptying said weighing mechanism when a predetermined weight of articles is received thereby, means for transporting the articles emptied from said weighing mechanism to an automatic bagging station, means for providing a supply of bags, means for automatically clamping a bag on two spaced sides thereof to hold it in open condition to be filled with articles, means for automatically indirectly sensing when the clamped bag is full, and means for sensing the grip on the bag by said clamping means, and for automatically recycling the clamping means to regrip the bag if the grip on the bag is insufficient, and for preventing transport of articles to the bag until the grip on said bag is sufficient.

37. A system as reicted in claim 36 wherein said clamping means comprises two pair of clamping pads, each pad having an opening formed therein in-line with a corresponding opening in the other pad of the pair, an air jet disposed in one of the openings of the pads of each pair, and a back-pressure switch for sensing the pressure in a pressure line leading to said air jets.

38. A system as recited in claim 37 wherein each of said clamp pads has sponge rubber disposed on the gripping surface thereof, and further comprising mounting means for mounting each of said pads for pivotal movement with respect to the others, and power means for effecting pivoting of said pads.

39. A discrete article weighing mechanism comprising a pan for receiving articles to be weighed, means responsive to the weight of articles in said pan for providing an indication of article weight, and pan surface means for channeling articles to the center and front of said pan without creating a bottleneck at which articles can bridge, said pan surface means comprising a pan bottom component formed of three substantially triangularly shaped surface portions; a first of said surface portions having the apex thereof at the front edge of said pan, and a base of each of the second and third surface portions being substantially coincident with said apex and on opposite sides thereof, said bases each slanting upwardly from said apex; and the first of said surface portions having a base at a back edge of said pan, the apex of each of said second and third surface portions being substantially coincident with said base and on opposite sides thereof.

40. A weighing mechanism as recited in claim 39 further comprising a spongy roller, means for mounting said roller in front of said pan to prevent movement of articles out of the pan front, means for mounting said pan for pivotal movement with respect to said roller, and means for effecting pivotal movement of said pan so that the front thereof moves below the level of said roller so that passage of articles out of said pan front is allowed.

41. A discrete article weighing mechanism comprising a pan for receiving articles to be weighed;

means responsive to the weight of articles in said pan for providing an indication of article weight;

a spongy roller;

means for mounting said roller in front of said pan to prevent movement of articles out of the pan front;

means for mounting said pan for pivotal movement with respect to said roller; and means for effecting pivotal movement of said pan so that the front thereof moves below the level of said roller so that passage of articles out of said pan front is allowed.

* * * * *